US007714552B2

(12) United States Patent
Gerber et al.

(10) Patent No.: US 7,714,552 B2
(45) Date of Patent: May 11, 2010

(54) LDO WITH LARGE DYNAMIC RANGE OF LOAD CURRENT AND LOW POWER CONSUMPTION

(75) Inventors: Johannes Gerber, Unterschleissheim (DE); Vadim V. Ivanov, Tucson, AZ (US); Ruediger Kuhn, Freising (DE)

(73) Assignee: Texas Instruments Incorporated, Dallas, TX (US)

( * ) Notice: Subject to any disclaimer, the term of this patent is extended or adjusted under 35 U.S.C. 154(b) by 70 days.

(21) Appl. No.: 12/196,379

(22) Filed: Aug. 22, 2008

(65) Prior Publication Data

US 2009/0096433 A1 Apr. 16, 2009

Related U.S. Application Data

(60) Provisional application No. 61/016,890, filed on Dec. 27, 2007.

(30) Foreign Application Priority Data

Aug. 30, 2007 (DE) ..... 10 2007 041 155

(51) Int. Cl.
*G05F 1/00* (2006.01)
*G05F 3/16* (2006.01)
*G05F 3/20* (2006.01)

(52) U.S. Cl. ..... 323/273; 323/280; 323/315; 323/316

(58) Field of Classification Search ..... 323/272–274, 323/277, 280, 312, 314–317; 327/403, 434, 327/530, 538, 541
See application file for complete search history.

(56) References Cited

U.S. PATENT DOCUMENTS 4,379,267 A * 4/1983 Young ..... 330/253
6,157,259 A * 12/2000 Dasgupta ..... 330/296
6,864,725 B2 3/2005 Cowles et al.
2004/0046538 A1 * 3/2004 Sivero et al. ..... 323/315
2005/0040807 A1 2/2005 Chen

FOREIGN PATENT DOCUMENTS

DE 69115551 11/1996
EP 0454243 10/1991

OTHER PUBLICATIONS

Dongpo Chen et al., "A Low-dropout Regulator with Unconditional Stability and Low Quiescent Current," Communications, Circuits and Systems Proceedings, 2006 International Conference On, IEEE, PI, Jun. 1, 2006, pp. 2215-2218, XP031010870, ISBN: 978-0-7803-9584-8.

(Continued)

*Primary Examiner*—Jessica Han
*Assistant Examiner*—Emily Pham
(74) *Attorney, Agent, or Firm*—Robert D. Marshall, Jr.; W. James Brady; Frederick J. Telecky, Jr.

(57) ABSTRACT

An electronic device has an LDO regulator for varying loads. The LDO regulator includes a primary supply node coupled to a primary voltage supply. An output node provides a secondary supply voltage and a load current. A bias current source generates a bias current. A gain stage coupled to the bias current source increases the maximum available load current. The gain stage includes a first MOS transistor biased in weak inversion coupled to a current mirror which mirrors the drain current through the first MOS transistor to the output node. The gate-source voltage of the first MOS transistor increases in response to a decreasing secondary supply voltage level at the output node to increase the available load current.

7 Claims, 2 Drawing Sheets

OTHER PUBLICATIONS

Gabriel A. Rincon-Mora et al., "Brief PapersA 1.1-V Current Mode and Piecewise-Linear Curvature-Corrected Bandgap Reference," IEEE Journal of Solid-State Circuits, IEEE Service Center, Piscataway, NJ, US, vol. 33, No. 10, Oct. 1, 1998, XP011060833, ISSN: 0018-9200.

Allen et al. "CMOS Analog Circuit Design." Oxford University Press, 2002. S. 393-402.

Vittoz et al. "CMOS Analog Integrated Circuits Based on Weak Inversion Operations." IEEE J. of Solid-State Circuits, vol. SC-12, No. 3, S. 224-231, Jun. 1977. [online].

Comer et al. "Using the Weak Inversion Region to Optimize Input Stage Design of CMOS Op Amps." IEEE T. on Circuits and Systems—II: Express Briefs, vol. 51, No. 1, S. 8-14, Jan. 2004. [online].

Madrenas et al. "A CMOS Analog Circuit for Gaussian Functions." IEEE T. on Circuits and Systems—II: Analog and Digital Signal Processing, vol. 43, No. 1, S. 70-74, Jan. 1996. [online].

* cited by examiner

LDO WITH LARGE DYNAMIC RANGE OF LOAD CURRENT AND LOW POWER CONSUMPTION

CLAIM OF PRIORITY

This application claims priority under 35 U.S.C. 119(a) to German Patent Application No. 10 2007 0041 155.5 filed Aug. 30, 2007 and 35 U.S.C. 119(e)(1) to U.S. Provisional Application No. 61/016,890 filed Dec. 27, 2007.

TECHNICAL FIELD OF THE INVENTION

The technical field of this invention is an LDO for use in an electronic device and more particularly, an LDO regulator with a high dynamic range for varying loads.

BACKGROUND OF THE INVENTION

A key parameter for microcontroller based applications and almost all applications including portable or mobile electronic devices is the current consumption in a low power mode (LPM). While the electronic system is in a low power mode, the CPU is typically idle and does not execute a program. The system consumes only an absolute minimum of current, just as much as is necessary in order to keep the system operable. Some applications need low drop out voltage regulators (LDOs) providing regulated supply voltages. The regulated supply voltage provided by the LDO must be maintained even during a LPM phase. Since supply current is limited and is the most valuable resource in the system, the current consumed by the LDO must be extremely low during LPM phases. In LPM phases the LDO is expected to consume and provide currents which are only in the order of nano Amperes (nA). However, there might be special situations, even in LPM where the LDO must provide currents that can be orders of magnitudes greater, for example several tens of micro Amperes (μA).

BACKGROUND OF THE INVENTION

This invention is an electronic device with an LDO which provides a large dynamic range of the load current while having very low self power consumption.

The present invention is an electronic device having an LDO regulator for varying loads. The LDO regulator has a primary supply node coupled to a primary voltage supply and an output node providing a secondary supply voltage and a load current. A bias current source generates a bias current. A gain stage coupled to the bias current source increases the maximum available load current. The gain stage includes a first MOS transistor biased in weak inversion. This first MOS transistor is coupled to a current mirror mirroring the drain current through the first MOS transistor to an output node. Further, the gate source voltage of the first MOS transistor increases in response to a decreasing secondary supply voltage level at the output node to increase the available load current. The bias current generated by the bias current source drives the first MOS transistor. The drain current of the first MOS transistor is mirrored using the current mirror so that the current received at the output node is proportional to the bias current. When the voltage at the output node (the secondary supply voltage) decreases the gate source voltage of the first MOS transistor increases because the first MOS transistor is biased in weak inversion (i.e. the gate voltage applied to the first MOS transistor is less than its threshold voltage). The current mirrored from the first MOS transistor to the output node increases, which increases the size of the load current at the output node. In this way, the LDO regulator only needs a very low current (e.g. about 100 nA to 300 nA) for its own operation and yet is able to drive a current of several tens of μA (for example 30 μA) as load current when in low power mode (LPM). The present invention thus allows the lowest supply current to be used, but is also able to deliver load currents that are orders of magnitude higher than in the unloaded case.

Preferably, the first MOS transistor has a gate coupled to a constant reference voltage level and a source coupled to a first node. The voltage level of the first node drops in response to the decreasing secondary supply voltage level at the output node. Thus the secondary supply voltage level at the output node is fed back to the gain stage. This causes the voltage at the first node to decrease when the voltage level at the output node decreases. This causes the gate source voltage of the first MOS transistor to increase further.

The gain stage may include a second MOS transistor and a third MOS transistor. The gate of the second MOS transistor is coupled to the output node, with a source of the second MOS transistor and a drain of the third MOS transistor coupled to the first node. A drain of the second MOS transistor is coupled to the bias current source and a gate of the third MOS transistor is coupled to the drain of the second MOS transistor. The secondary supply voltage at the output node is then the voltage applied to the gate of the second MOS transistor. Thus, as the secondary supply voltage decreases, the gate voltage of the second MOS transistor decreases and the amount of current from the bias current source through the second MOS transistor decreases, leading to a voltage decrease at the first node.

The current mirror preferably comprises a diode connected fourth MOS transistor and a fifth MOS transistor having a gate coupled to a gate of the fourth MOS transistor and biased in weak inversion. A drain of the fourth MOS transistor is coupled to a drain of the first MOS transistor and a source of the fourth MOS transistor coupled to a resistive element such that the gate source voltage of the fifth MOS transistor corresponds to combined voltages of both the gate source voltage of the fourth MOS transistor and a voltage drop across the resistive element. The fourth and fifth MOS transistors then form the current mirror and mirror the current from the first MOS transistor to the output node.

In another aspect of the present invention includes a sixth MOS transistor. The gate of the third MOS transistor is coupled through the sixth MOS transistor to the drain of the third MOS transistor. A drain of the sixth MOS transistor is coupled to the gate of the third MOS transistor. A source of the sixth MOS transistor is coupled to the drain of the second MOS transistor. The source of the sixth MOS transistor is further coupled to a second bias current source. A gate of the sixth MOS transistor receives a constant voltage level. The sixth MOS transistor closes the feedback loop to the third MOS transistor without restrictions on the voltage input range and has a common gate configuration so that the dominant pole of the feedback loop will be at the gate of the third MOS transistor. The stability of the LDO circuit is then assured since all circuit loops are single pole only. Addition of the sixth MOS transistor to the feedback loop increases the voltage input range to the gain stage fed back from the output node.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
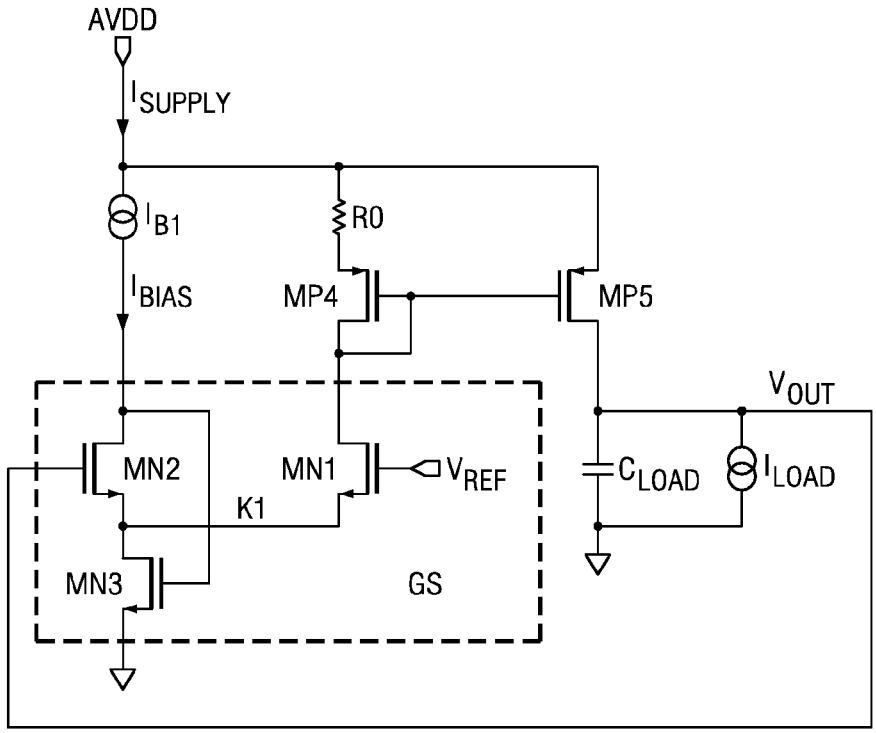
FIG. 1 is a simplified circuit diagram of an LDO regulator according to a first embodiment of the invention.

FIG. 1 shows a simplified circuit diagram of an LDO regulator according to a first embodiment of the invention. The LDO regulator shown is for use in an electronic device such as a microcontroller.

Primary supply voltage node AVDD is connected to a primary voltage supply, the DC voltage supply of the device including the LDO regulator. Supply voltage node AVDD is connected to bias current generator $I_{B1}$, which generates a bias current $I_{BIAS}$, resistor R0 and the source terminal of PMOS transistor MP5. Resistor R0 is connected to the source terminal of another PMOS transistor MP4. The gate terminals of transistors MP4 and MP5 are interconnected so that transistors MP4 and MP5 form a current mirror stage. Transistor MP4 is diode connected; i.e., its gate and drain terminals are interconnected. Both bias current generator $I_{B1}$ and the current mirror stage are connected to a gain stage GS. Gain stage GS includes first, second and third NMOS transistors MN1, MN2 and MN3. First NMOS transistor MN1 has a drain terminal connected with the gate and drain of transistor MP4 in the current mirror stage. The gate of first NMOS transistor MN1 is connected to reference voltage source $V_{REF}$. The source terminal of transistor MN1 is connected to the source terminal of second NMOS transistor MN2 and to the drain terminal of third NMOS transistor MN3 at node K1. The source terminal of transistor MN3 is connected to ground. The gate terminal of transistor MN3 is connected to a node interconnecting bias current generator $I_{B1}$ and the drain terminal of transistor MN2. The drain terminal of transistor MP5 at the output of the current mirror stage is connected to an output node $V_{OUT}$, which provides a secondary supply voltage and a load current ($I_{LOAD}$). The current mirror stage formed of transistors MP4 and MP5 mirrors current from transistor MN1 in the gain stage GS to output node $V_{OUT}$. Output node $V_{OUT}$ is also connected to the gate terminal of transistor MN2 forming a feedback loop to gain stage GS. Load capacitor $C_{LOAD}$ is connected between output node $V_{OUT}$ and ground.

Initially, load current $I_{LOAD}$ at output node $V_{OUT}$ is low and is of the order of current $I_{BIAS}$ generated by bias current source $I_{B1}$. Transistor MN2 is driven by bias current $I_{BIAS}$. Due to the gate voltages of transistors MN1 and MN2 being about the same (the gate voltage of transistor MN1 is reference voltage $V_{REF}$), a current $I_{BIAS}$ also flows through transistor MN1 if transistors MN1 and MN2 are symmetrical. The current through transistor MN1 is mirrored by the current mirror stage MP4, MP5 and R0 to output node $V_{OUT}$. The output voltage at output node $V_{OUT}$ is fed back to the gain stage GS at the gate of transistor MN2. The drain current through transistor MN3 is controlled by a regulation loop provided by the gate of transistor MN3 being connected to the bias current source $I_{B1}$ and can be chosen equal to twice the bias current $I_{BIAS}$. Since the output is initially loaded only with a very small load current, which is about equal to the bias current $I_{BIAS}$, the gate-source voltage of transistor MP5 in the current mirror stage is approximately equal to the gate source voltage of transistor MP4 in the current mirror since the voltage drop across the resistor R0 can be neglected for small currents. Thus:

$$V_{GS}*MP5=V_{GS}*MP4.$$

As load current $I_{LOAD}$ at output node $V_{OUT}$ becomes larger, the output voltage, or secondary supply voltage at the output node $V_{OUT}$ will eventually decrease. The decrease in output voltage fed back to the gate of transistor MN2 therefore causes the node K1 to be pushed to lower voltages. This opens the gate source voltage of transistor MN1. Thus the gate source voltage of transistor MN1 and therefore the current flowing through transistor MN1 will increase. This means that the gate source voltage of transistor MP5 in the current mirror will become equal to the gate source voltage of transistor MP4 plus the voltage across the resistor R0. This boosts the current through transistor MP5:

$$V_{GS}*MP5=V_{GS}*MP4+V_{R0}.$$

The sum of the currents flowing through transistors MN1 and MN2 will then be received at transistor MN3. This is controlled by the regulation loop. In other words, the decrease in output voltage at output node $V_{OUT}$ increases the gate source voltage at transistor MN1, and therefore at transistor MP5 in the current mirror. These transistors MN1 and MP5 are in deep subthreshold, because of being biased in weak inversion. When their gate source voltages are changed there will be an exponential increase of drain currents in both transistors MN1 and MP5. Therefore this circuit offers a large dynamic range of output currents at the drain of transistor MP5 and thus at the output node $V_{OUT}$ for just a small drop of output voltage at output node $V_{OUT}$.

Without an external load current, the LDO circuit operates with a very low bias current $I_{BIAS}$ of the order of 10 nA. Overall the LDO consumes a supply current $I_{SUPPLY}$ of between 200 nA and 300 nA. In terms of external current loading, the LDO can deliver a load current $I_{LOAD}$ that is orders of magnitude higher than the bias current $I_{BIAS}$. Therefore the LDO achieves both a low current consumption at a low $I_{SUPPLY}$ and a high potential load current drive in combination.

Figure 2:
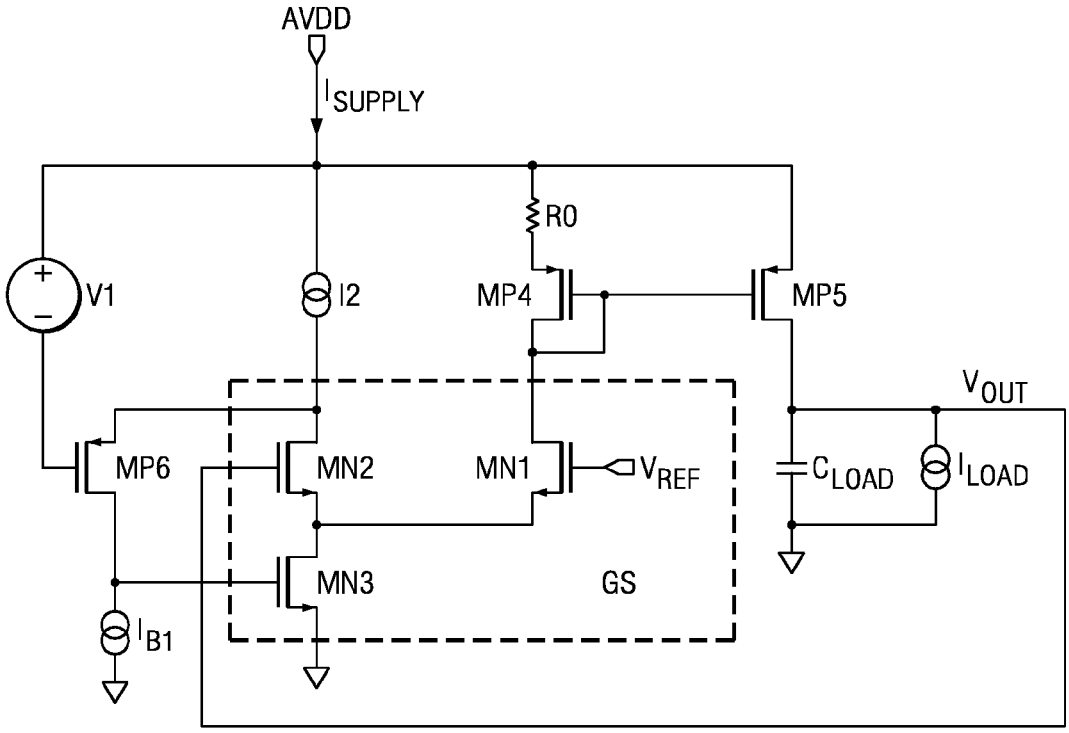
FIG. 2 is a simplified circuit diagram of an LDO regulator according to a second embodiment of the invention.

In FIG. 1, the other feedback loop controlling the gate voltage of transistor MN3 is directly connected to the drain of transistor MN2. This means that the voltage input range at the gate of transistor MN2 is limited due to the feedback connection of transistor MN3. FIG. 2 shows a second embodiment of the invention that overcomes this drawback of the circuit in FIG. 1. The LDO circuit shown in FIG. 2 is almost the same as that shown in FIG. 1, except that the bias current source $I_{B1}$ is moved from the position shown in FIG. 1, between the supply voltage node AVDD and the drain of transistor MN2, and is instead connected between the gate of transistor MN3 and ground. A second current source I2 is then connected between the supply voltage node AVDD and the drain of transistor MN2 in place of the bias current source $I_{B1}$. A node interconnecting the gate of transistor MN3 and the bias current generator $I_{B1}$ is connected to the drain of an additional PMOS transistor MP6. The source of transistor MP6 is connected to a node interconnecting the current source I2 and the drain of transistor MN2, with the gate of transistor MP6 being connected to a constant voltage source V1.

The additional transistor MP6 closes the feedback loop to transistor MN3 without the restrictions on the voltage input range exhibited by the LDO circuit of FIG. 1. Since transistor MP6 is in a common gate configuration, the dominant pole of the loop will be at the gate of transistor MN3. There will always be sufficient phase margin and the stability of this circuit is always assured, since both of the feedback loops $V_{OUT}$-MN2-MN1-MP4-MP5 and MN3-MN2-MP6 only have a single pole. The outer feedback loop from the output voltage node $V_{OUT}$ ($V_{OUT}$-MN2-MN1-MP4-MP5) is dominated by the load capacitor $C_{LOAD}$. Load capacitor $C_{LOAD}$ preferably has a capacitance of 470 nF in this example. The inner loop (MN3-MN2-MP6) has one pole at the gate of transistor MN3.

Figure 3:
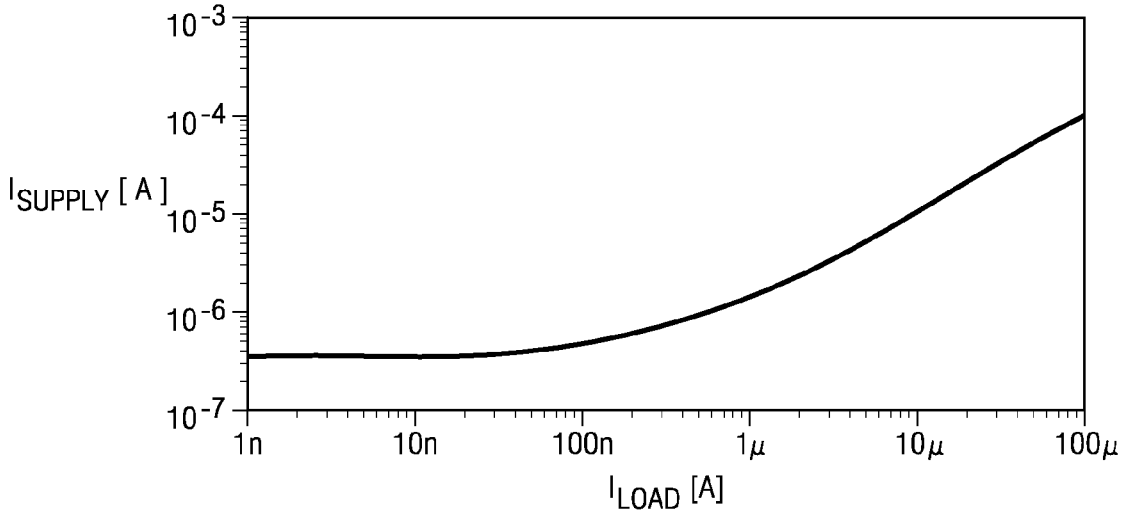
FIG. 3 is a logarithmic graph of supply current as a function of load current for an LDO regulator according to the invention.
Figure 4:
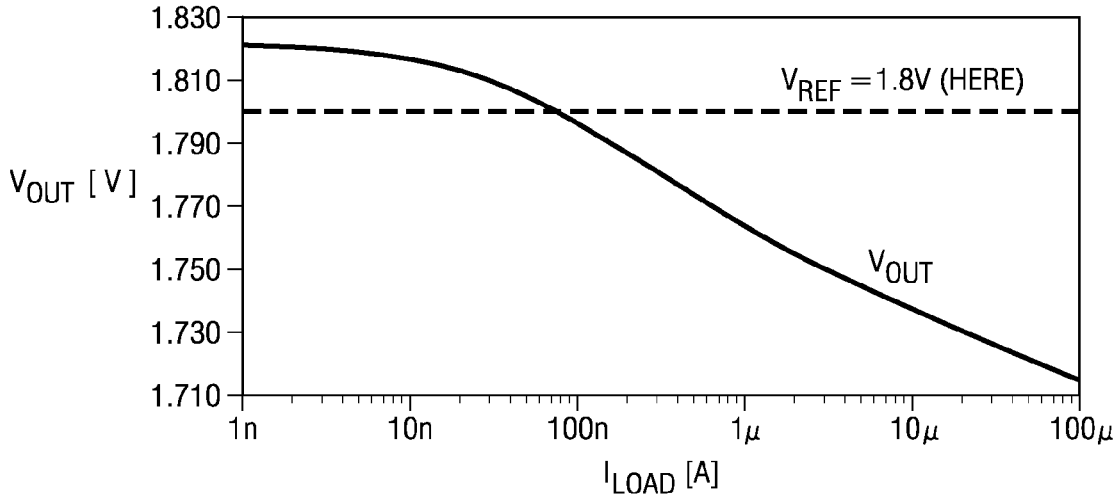
FIG. 4 is a logarithmic graph of LDO output voltage as a function of load current for an LDO regulator according to the invention.

FIGS. 3 and 4 show the DC response of the LDO circuit for the circuit shown in FIG. 2. The circuit shown in FIG. 1 has basically the same behavior. FIG. 3 illustrates load current $I_{LOAD}$ in terms of supply current $I_{SUPPLY}$ on a logarithmic scale. FIG. 4 illustrates load current $I_{LOAD}$ in terms of the output voltage at the output voltage node $V_{OUT}$ on a semi-logarithmic scale. In this example, reference voltage $V_{REF}$ applied to the gate terminal of transistor MN1 is 1.8 V. When the load current $I_{LOAD}$ at the output voltage node $V_{OUT}$ is near or equal to zero, the supply current is around 300 nA. As the load current $I_{LOAD}$ increases, the LDO output voltage $V_{OUT}$ decreases and it can be seen that the circuit can deliver a load current $I_{LOAD}$ of up to about 100 μA.

Although the present invention has been described with reference to specific embodiments, it is not limited to these embodiments and no doubt further alternatives will occur to the skilled person that lie within the scope of the invention as claimed.

What is claimed is:

1. An electronic device having an LDO regulator for varying loads, the LDO regulator comprising:

a primary supply node (AVDD) adapted to be coupled to a primary voltage supply;

an output node ($V_{OUT}$) providing a secondary supply voltage and a load current ($I_{LOAD}$);

a bias current source ($I_{B1}$) generating a bias current; and a gain stage (GS) including a first MOS transistor (MN1) coupled to said bias current source and biased in weak inversion, and a current mirror coupled to said first MOS transistor (MN1) to mirror a drain current through said first MOS transistor to said output node;

wherein a gate-source voltage of said first MOS transistor (MN1) increases in response to a decreasing secondary supply voltage level at said output node ($V_{OUT}$) to thereby increase the available load current ($I_{LOAD}$).

2. The electronic device according to claim 1, wherein:

said first MOS transistor (MN1) has a gate coupled to a constant reference voltage level ($V_{REF}$) and a source coupled to a first node (K1), a voltage level of said first node (K1) drops in response to a decreasing secondary supply voltage level at the output node ($V_{OUT}$).

3. The electronic device according to claim 1, wherein;

said gain stage (GS) further includes a second MOS transistor (MN2) having a gate coupled to said output node ($V_{OUT}$), a source connected said first node (K1) and a drain connected to said bias current source ($I_{B1}$), a third MOS transistor (MN3) having a gate connected to drain of said second MOS transistor (MN2), a source connected to ground and a drain connected to connected said first node (K1).

4. The electronic device according to claim 1, wherein:

said current mirror includes a resistor (R0) having a first terminal connected to said primary supply node (AVDD) and a second terminal, a diode connected fourth MOS transistor (MP4) having a source connected to said second terminal of said resistor (R0) and a gate and a drain connected of said source of said the first MOS transistor (MN1), and a fifth MOS transistor (MP5) being biased in weak inversion and having a gate coupled to gate of said fourth MOS transistor (MP4, a source connected to said primary supply node (AVDD) and a drain connected to said output node ($V_{OUT}$), whereby a gate-source voltage of said fifth MOS transistor (MP5) corresponds to combined voltages of said gate-source voltage of said fourth MOS transistor (MP4) and a voltage drop across said resistor (R0).

5. An electronic device having an LDO regulator for varying loads, the LDO regulator comprising:

a primary supply node (AVDD) adapted to be coupled to a primary voltage supply;

an output node ($V_{OUT}$) providing a secondary supply voltage and a load current ($I_{LOAD}$);

a current source (I2) generating a current; and a gain stage (GS) including a first MOS transistor (MN1) coupled to said current source and biased in weak inversion, and a second MOS transistor (MN2) having a gate coupled to said output node ($V_{OUT}$), a source connected a first node (K1) and a drain connected to said bias current source ($I_{B1}$), a third MOS transistor (MN3) having a gate, a source connected to ground and a drain connected to connected said first node (K1);

a voltage source (V1) having a first terminal connected to said primary supply node (AVDD) and a second terminal, a fourth MOS transistor (MP6) having a gate of connected to said second terminal of said voltage source (V1), a source connected to said source of said second MOS transistor (MN2) and a drain connected to said gate of said third MOS transistor (MN3), and a bias current source ($I_{B1}$) having a first terminal connected to said drain of said fourth MOS transistor (MN6) and a second terminal connected to ground;

a current mirror coupled to said first MOS transistor (MN1) to mirror a drain current through said first MOS transistor to said output node;

wherein a gate-source voltage of said first MOS transistor (MN1) increases in response to a decreasing secondary supply voltage level at said output node ($V_{OUT}$) to thereby increase the available load current ($I_{LOAD}$).

6. The electronic device according to claim 5, wherein:

said first MOS transistor (MN1) has a gate coupled to a constant reference voltage level ($V_{REF}$) and a source coupled to a first node (K1), a voltage level of said first node (K1) drops in response to a decreasing secondary supply voltage level at the output node ($V_{OUT}$).

7. The electronic device according to claim 5, wherein:

said current mirror includes a resistor (R0) having a first terminal connected to said primary supply node (AVDD) and a second terminal, a diode connected fifth MOS transistor (MP4) having a source connected to said second terminal of said resistor (R0) and a gate and a drain connected of said source of said the first MOS transistor (MN1), and a sixth MOS transistor (MP5) being biased in weak inversion and having a gate coupled to gate of said fifth MOS transistor (MP4), a source connected to said primary supply node (AVDD) and a drain connected to said output node ($V_{OUT}$), whereby a gate-source voltage of said sixth MOS transistor (MP5) corresponds to combined voltages of said gate-source voltage of said fifth MOS transistor (MP4) and a voltage drop across said resistor (R0).

* * * * *